United States Patent [19]

Bachmann et al.

[11] Patent Number: 4,586,699

[45] Date of Patent: May 6, 1986

[54] REFRACTORY PLATE ASSEMBLY FOR USE IN SLIDING CLOSURE UNIT

[75] Inventors: Herbert Bachmann, Lucerne; Anton Schwyter, Buonas, both of Switzerland

[73] Assignee: Stopinc Aktiengesellschaft, Baar, Switzerland

[21] Appl. No.: 636,247

[22] Filed: Jul. 31, 1984

[30] Foreign Application Priority Data

Sep. 2, 1983 [CH] Switzerland ..... 4822/83

[51] Int. Cl.[4] ..... B22D 41/08

[52] U.S. Cl. ..... 266/287; 222/600

[58] Field of Search ..... 266/236, 271, 272, 287; 222/600, 599, 591

[56] References Cited

U.S. PATENT DOCUMENTS

| | | | |
|---|---|---|---|
| 4,182,466 | 1/1980 | Fehling et al. | 222/600 |
| 4,327,847 | 5/1982 | Tinnes | 222/600 |
| 4,344,550 | 8/1982 | Szadkowski | 222/600 |
| 4,386,765 | 6/1983 | Roberts et al. | 266/236 |

FOREIGN PATENT DOCUMENTS

| | | | |
|---|---|---|---|
| 2036938 | 6/1980 | United Kingdom | 222/600 |

*Primary Examiner*—L. Dewayne Rutledge
*Assistant Examiner*—S. Kastler
*Attorney, Agent, or Firm*—Wenderoth, Lind & Ponack

[57] ABSTRACT

A refractory plate assembly for use as a stationary or a movable refractory plate in a sliding closure unit includes a refractory supporting body and a refractory disc-shaped member forming a sliding sealing surface of the assembly. The disc-shaped member is loosely and removably mounted to the supporting body in a manner to prevent the disc-shaped member from working loose from and moving relative to the supporting body.

7 Claims, 8 Drawing Figures

REFRACTORY PLATE ASSEMBLY FOR USE IN SLIDING CLOSURE UNIT

BACKGROUND OF THE INVENTION

The present invention relates to a refractory plate assembly having therethrough at least one discharge opening and for use in a slide gate nozzle or sliding closure unit.

More particularly, the present invention is directed to such a refractory plate assembly for use as a stationary refractory plate or as a movable refractory plate and of the type including a supporting body which is provided with a separate member forming at least a part of the sliding sealing surface.

A sliding closure unit for the regulating of the flow of molten metal usually contains two closing plates formed of refractory material, one stationary plate and one movable plate, which abut on and coact with one another along respective sliding sealing surfaces. As is known, during operation these closing plates are subjected to high stresses, for example thermal stress, erosion, chemical attack, etc., such that the plates must be replaced periodically. However, depending upon the conditions of use, particularly on the type of molten metals involved, these stresses are completely different for different parts of the plates. In many cases, the important factor is that one or both of the closing plates be provided on their sliding sealing surfaces, or at least on parts thereof, with special properties, for example with respect to wear resistance, sliding properties, abrasion characteristics, heat conductivity, etc.

In the past, there have been proposals wherein a closing plate includes a refractory supporting body which is provided at the area of the sealing surface with a special sliding layer, for example Japanese Patent Publication No. 44-26935, West German DE-OS No. 1 935 424, West German DE-OS No. 1 937 742 and West German DE-OS No. 2 719 105.

However, according to these known arrangements, the sliding layer is rigidly and inseparably connected with the refractory supporting body. In other words, this known type of closing plate is designed as a composite body and can be replaced only in its entirety. The fabrication of such composite bodies however is very expensive and, due to the rigid bonding of the different materials usually having different coefficients of heat expansion, additional problems may arise.

Situations arise however where advanced wear or the like on the sealing surface member or on the sliding member limits the useful life of the entire plate, while the supporting body still would be usable. Under such conditions, the entire closing plate must be replaced. However, this obviously is not economical.

SUMMARY OF THE INVENTION

With the above discussion in mind, it is the object of the present invention to provide a refractory plate assembly for use as a stationary refractory plate or as a movable refractory plate in a sliding closure unit, whereby it is possible to overcome the above and other prior art disadvantages.

It is a more specific object of the present invention to provide such a refractory plate assembly which is easy and more economical to manufacture than known refractory plate assemblies.

It is a further specific object of the present invention to provide such a refractory plate assembly whereby it is possible to replace either the supporting body or the special sliding layer member, selectively without replacing the entire assembly.

The above and other objects are achieved in accordance with the present invention by the provision of an assembly including a refractory supporting body and a refractory disc-shaped member forming a sliding sealing surface of the assembly, and means for loosely and removably mounting the disc-shaped member to the supporting body while preventing the disc-shaped member from working loose from and moving relative to the supporting body, the assembly having therethrough at least one discharge opening.

By mounting the disc-shaped member to the supporting body loosely and removably, while preventing relative movement, it is possible, at the site of use, to replace only the disc-shaped member while the supporting body can be used further. Furthermore, since there is no rigid and integral connection between the two elements of the assembly, problems do not occur due to different coefficients of heat expansion of the two elements.

In accordance with one arrangement of the present invention the mounting and preventing means comprises a recess formed in the supporting body, the disc-shaped member fitting within such recess, and means for preventing the disc-shaped member from sliding within the recess relative to the supporting body. The disc-shaped member and the recess may be of mating circular configuration, and the sliding preventing means may comprise a pin extending through the disc-shaped member into the supporting body. Alternatively, the disc-shaped member and the recess may be of generally mating non-circular configuration, and the sliding preventing means may comprise mutual abutting non-circular surfaces of the disc-shaped member and of the supporting body defining the recess.

In accordance with a further arrangement of the present invention, the mounting and preventing means comprises a metal support member having therein a recess, the supporting body and the disc-shaped member both fitting into the recess, and means for preventing the supporting body and the disc-shaped member from sliding within the recess relative to the support member and therefore with respect to each other. The supporting body, the disc-shaped member and the recess may be of generally the same non-circular configuration, and the sliding preventing means may comprise non-circular surfaces of the supporting body and the disc-shaped member abutting at least one complementary surface of the support member defining the recess. Alternatively, the sliding preventing means may be in the form of one or more coupling pins extending through the disc-shaped member and the supporting body into the support member.

It is to be understand that as employed herein the term "sliding" is intended to refer to both linear and rotary motion between the disc-shaped member and the supporting body in directions parallel to the sliding sealing surface. Furthermore, as employed herein the term "disc" is not intended to be limited to a circular-shaped element, but rather is intended to refer to a relatively thin, flat element, as will be apparent from the following detailed description.

Although the supporting body and the disc-shaped member defining the closing plate of the present invention lie loosely on one another during use, that is to say that there is no sealing engagement or permanent binding between two elements, it has been shown that during normal operation no molten metal flowing through the discharge opening will enter between the abutting surfaces of such two elements. However, in accordance with a further feature of the present invention it is possible to further prevent such molten metal entry, which may occur under some conditions. Thus, the disc-shaped member may include an integral sleeve defining the discharge opening and extending into or through the supporting body.

It is to be understood that the refractory closing plate assembly of the present invention is applicable either to the stationary refractory plate or to the movalbe refractory plate in any of linear, rotary or swiveling sliding closure units, as will be understood by those skilled in the art.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
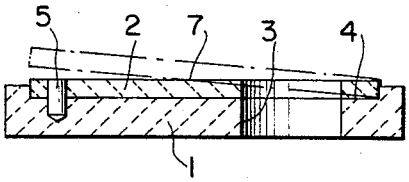
FIGS. 1 and 2 respectively are a cross-section and a plan view of a first embodiment of a refractory closure plate assembly for use in a rotary sliding closure unit according to the present invention.
Figure 2:
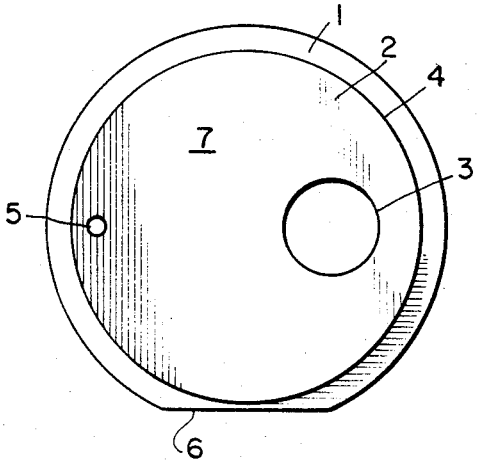

With reference to FIGS. 1 and 2 of the drawings, a first embodiment of the present invention will be described. Thus, a refractory closure plate assembly includes a refractory supporting body 1 and a separate refractory disc-shaped member 2 which forms a sliding sealing surface 7 of the plate assembly. The members 1 and 2 have therethrough openings defining a discharge opening 3. The disc-shaped member 2 is loosely and removably mounted to supporting body 1 in a manner to prevent the disc-shaped member 2 from working loose from and moving relative to supporting body 1. In the embodiment of FIGS. 1 and 2 this is achieved by the formation of a recess 4 in supporting body 1. As will be apparent from FIG. 2, recess 4 and member 2 are of a mating circular configuration. A coupling pin 5 extends through member 2 and into supporting body 1. Thus, elements 1 and 2 are prevented from working loose from each other due to the rim or periphery of disc 2 being carried within recess 4 and due to the eccentrically located pin 5 preventing member 2 from rotating within recess 4 relative to body 1.

The material of member 2 normally is of a material which is different from that of body 1 and forms a layer defining sliding sealing surface 7. During use of the assembly, such surface is tightly pressed against a corresponding surface of the other closure plate of the assembly.

Member 2 is not fixedly connected to body 1 but is loosely and interchangeably mounted thereon, as will be apparent from the dashed lines in FIG. 1.

The supporting body 1 is designed in a known manner to be inserted into a metal supporting frame of a rotary sliding closure unit, with a lateral face 6 of the body 1 serving for clamping or for rotation.

Figure 3:
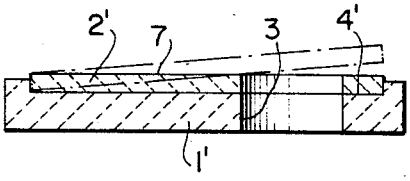
FIGS. 3 and 4 respectively are similar to FIGS. 1 and 2 but of a second embodiment of an assembly for use in a rotary sliding closure unit.
Figure 4:
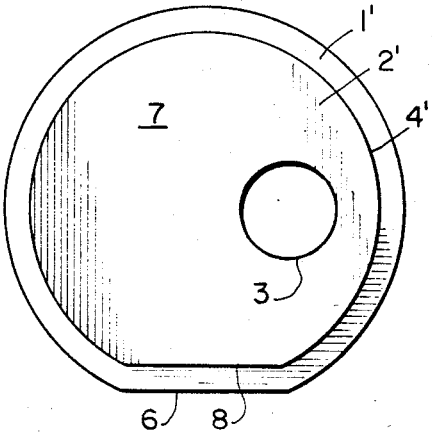

The rotary plate assembly as shown in FIGS. 3 and 4 generally is similar to the above described embodiment of FIGS. 1 and 2. The difference involves the manner of preventing relative sliding of member 2' within recess 4' of body 1'. Thus, this embodiment avoids the use of the separate pin 5 and rather forms the disc-shaped member 2' and the recess 4' of generally mating non-circular configuration. Sliding of the member 2' within recess 4' is prevented by mutual abutting non-circular surfaces 8. It will be apparent that the same effect could be achieved by use of other, non-circular configurations.

Figure 5:
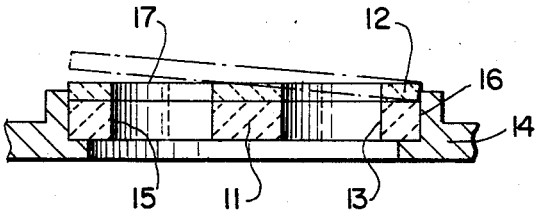
FIGS. 5 and 6 respectively are similar to FIGS. 1 and 2 but of a third embodiment of an assembly for use in a rotary sliding closure unit.
Figure 6:
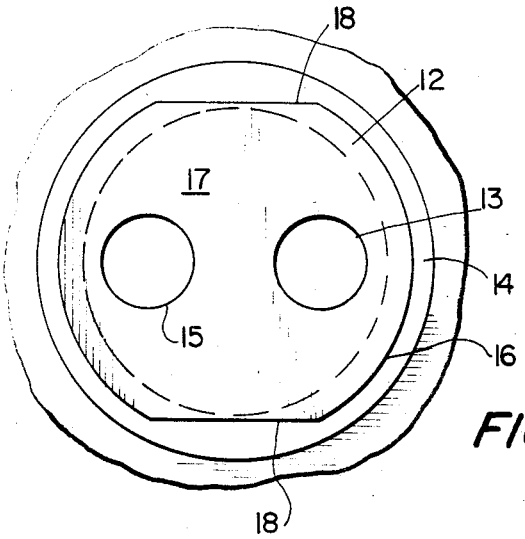

In the embodiment of FIGS. 5 and 6, which shows the refractory plate assembly having therethrough two discharge openings 13, 15, a supporting body 11 and a disc-shaped member 12 defining a sealing surface 17 are fitted separately into a common recess 16 formed in a metal holding frame or support member 14. The two elements 11, 12 are not locked directly against each other to prevent relative sliding movement therebetween. Rather, elements 11 and 12 separately are prevented from rotation relative to support member 14, and therefore with respect to each other. Thus, recess 16 has a non-circular configuration, and the elements 11 and 12 have generally the same non-circular configuration. Thus, as illustrated, the recess 16 and the elements 11, 12 are partially defined by non-circular surfaces, for example segmental surfaces 18 which mutually abut each other. It is to be understood that relative rotation of the elements 11, 12 within recess 16 could be prevented by other non-circular configurations, or with one or more coupling pins such as employed in the embodiment of FIG. 1.

Figure 7:
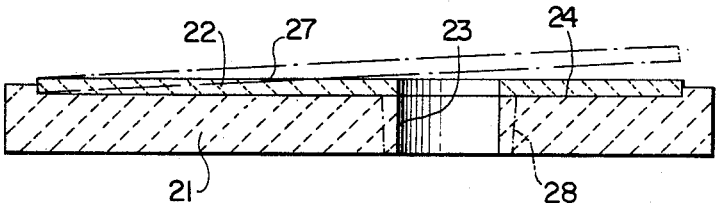
FIGS. 7 and 8 are similar to FIGS. 3 and 4 but of a fourth embodiment of an assembly for use in a linear sliding closure unit.
Figure 8:
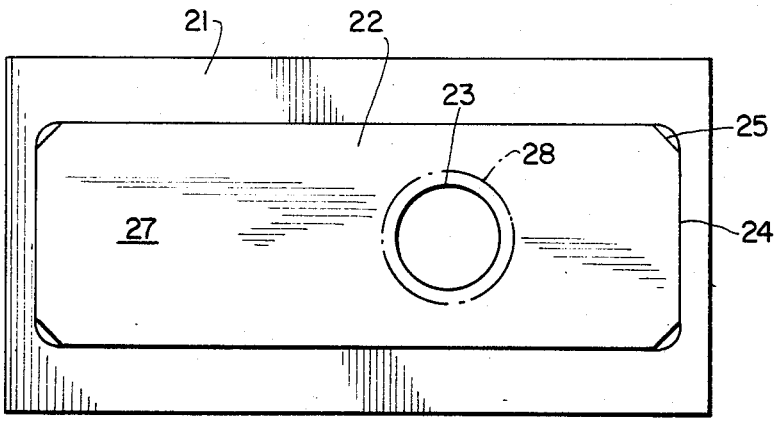

The above described embodiments refer to refractory plate assemblies employed in rotary sliding closure units. However, FIGS. 7 and 8 illustrate a plate assembly for use in a linear sliding closure unit. Thus, a rectangular plate-shaped supporting body 21 has therein a rectangular recess 24 into which is loosely and interchangeably fitted a generally rectangular disc-shaped member 22 defining sliding sealing surface 27 and having beveled corners 25. The assembly has therethrough a discharge opening 23 formed by bore holes through the two elements.

This embodiment illustrates a further feature of the present invention. Thus, as a rule it has been shown that the resulting joint in the wall of the discharge opening between the two superposed parts 21, 22 will not result in molten metal passing into such joint. This particularly is true since during operating conditions the elements are pressed together in the sliding closure unit and do not move relative to each other.

However, in the event that under particular circumstances there is a tendency for molten metal to enter such joint, this may be overcome by a modification of the present invention illustrated by dashed lines in FIGS. 7 and 8. Thus, the disc-shaped member 22 has integrally formed therewith a sleeve defining the discharge opening and extending into or through an appropriately flared bore hole in the supporting body 21. It of course will be understood that this feature of the present invention equally is applicable to the above-discussed other embodiments of the present invention.

It is intended to be within the scope of the present invention that the sliding layer formed by the loosely inserted disc-shaped member may not form the entire sealing surface of the assembly, but only a part thereof. For example, in the embodiments of FIGS. 1–4 and 7, 8, the recess formed in the supporting body may be precisely as deep as the thickness of the disc-shaped member. In such arrangement, the upper side of the supporting body extending outwardly around the disc-shaped member will be flush with the upper surface of the disc-shaped member and will form a part of the respective sliding sealing surface.

It is to be understood that the refractory closure plate assembly of the present invention is intended for insertion in a known manner as a stationary and/or movable plate of a sliding closure unit of the rotary type, for example as shown in European Patent Application No. 0 040 692, or of the linear type, as disclosed in West German DE-OS No. 3 208 101.

The use of an assembled or combination closure plate is advisable in cases where very specific requirements are imposed on the material forming the sliding sealing layer, for example in conjunction with various non-ferrous, especially light-metal, melts (see particularly West German DE-OS No. 3 321 619). Under certain conditions, the sliding layer made of such material must be replaced after specific operating periods. In the plate assembly according to the present invention, this replacement may be achieved very rapidly and simply merely by removing the loose disc-shaped member from the supporting body and inserting a new disc-shaped member, while the supporting body remains in service. The supporting body specifically need not be disassembled from the sliding closure unit.

Accordingly, the supporting body is made of a material, normally a refractory material, that is sufficiently resistant to the particular molten metal being processed and withstands the mechanical stresses (pressure, flexure, heat expansion, etc.) to which it is subjected during operation. This results in a very economical operation and requires only brief shutdowns when the spent disc-shaped member has to be replaced. Furthermore, the fabrication of the present plate assembly is much simpler than that of known composite plates. Even further, various disc-shaped members formed of different materials for different applications, all of which may be employed with the same supporting body, easily may be stored in a smaller warehouse area. Finally, since the disc-shaped member is not rigidly connected to the supporting body, the fabrication of the two elements of different materials having different heat expansion characteristics will not result in heretofore occurring operational problems.

Although the present invention has been described and illustrated with respect to preferred embodiments thereof, various modifications may be made to the specifically described and illustrated arrangements without departing from the scope of the present invention.

What is claimed is:

1. A refractory plate assembly for use as a stationary refractory plate or as a movable refractory plate in a sliding closure unit, said assembly comprising:

a refractory supporting body;

a refractory disc-shaped member forming a sliding sealing surface of said assembly;

means for removably mounting said disc-shaped member to said supporting body without permanent binding therebetween while preventing said disc-shaped member from working loose from and moving relative to said supporting body, with said refractory supporting body and said refractory disc-shaped member having surfaces in abutting contact without the interposition therebetween of a metallic sheath; and at least one discharge opening extending through said disc-shaped member and said supporting body.

2. An assembly as claimed in claim 1, wherein said mounting and preventing means comprises a recess formed in said supporting body, said disc-shaped member fitting within said recess, and means for preventing said disc-shaped member from sliding within said recess relative to said supporting body.

3. An assembly as claimed in claim 2, wherein said disc-shaped member and said recess are of mating circular configuration, and said sliding preventing means comprises a pin extending through said disc-shaped member into said supporting body.

4. An assembly as claimed in claim 2, wherein said disc-shaped member and said recess are of generally mating non-circular configuration, and said sliding preventing means comprise mutual abutting non-circular surfaces.

5. An assembly as claimed in claim 1, wherein said mounting and preventing means comprises a metal support member having therein a recess, said supporting body and said disc-shaped member commonly fitting into said recess, and means for preventing said supporting body and said disc-shaped member from sliding within said recess relative to said support member and therefore with respect to each other.

6. An assembly as claimed in claim 5, wherein said supporting body, said disc-shaped member and said recess are of generally the same non-circular configuration, and said sliding preventing means comprises non-circular surfaces of said supporting body and of said disc-shaped member abutting at least one complementary surface of said support member defining said recess.

7. An assembly as claimed in claim 1, wherein said disc-shaped member includes an integral sleeve defining said discharge opening and extending into said supporting body.

* * * * *